US006279653B1

(12) United States Patent
Wegener et al.

(10) Patent No.: US 6,279,653 B1
(45) Date of Patent: Aug. 28, 2001

(54) HEAVY OIL VISCOSITY REDUCTION AND PRODUCTION

(75) Inventors: Dennis C. Wegener; David R. Zornes; Daniel R. Maloney; Michael E. Vienot, all of Bartlesville, OK (US); Michael Lee Fraim, Bakersfield, CA (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/201,925

(22) Filed: Dec. 1, 1998

(Under 37 CFR 1.47)

(51) Int. Cl.[7] ..... E21B 43/00; E21B 28/00
(52) U.S. Cl. ..... 166/249; 166/177.2; 166/66.5
(58) Field of Search ..... 166/66.5, 249, 166/279, 177.1, 177.2, 177.6, 177.7

(56) References Cited

U.S. PATENT DOCUMENTS

| | | | | |
|---|---|---|---|---|
| 2,871,943 | | 2/1959 | Bodine, Jr. . | |
| 2,918,126 | * | 12/1959 | Bodine . | |
| 3,016,093 | | 1/1962 | Bodine . | |
| 3,497,005 | * | 2/1970 | Pelopsky et al. | 166/247 |
| 3,578,081 | | 5/1971 | Bodine | 166/249 |
| 3,754,598 | * | 8/1973 | Halloway | 166/249 |
| 3,823,776 | | 7/1974 | Holmes | 166/261 |
| 3,927,716 | | 12/1975 | Burdyn et al. | 166/270 |
| 3,952,800 | * | 4/1976 | Bodine | 166/249 |
| 4,019,683 | | 4/1977 | Asai et al. | 239/102 |
| 4,037,656 | | 7/1977 | Cooper | 166/270 |
| 4,437,518 | | 3/1984 | Williams | 166/248 |
| 4,485,021 | | 11/1984 | Purcell et al. | 252/8.55 D |
| 4,493,371 | | 1/1985 | Reisberg et al. | 166/274 |
| 4,509,599 | | 4/1985 | Chenoweth et al. | 166/370 |
| 4,885,098 | | 12/1989 | Bodine | 210/702 |
| 5,083,613 | * | 1/1992 | Gregoli et al. | 166/275 |
| 5,184,678 | | 2/1993 | Pechkov et al. | 166/249 |
| 5,282,508 | | 2/1994 | Ellingsen et al. | 166/249 |
| 5,291,949 | | 3/1994 | Dovan et al. | 166/295 |
| 5,382,371 | | 1/1995 | Stahl et al. | 507/221 |
| 5,538,628 | | 7/1996 | Logan | 210/198.1 |
| 5,547,563 | | 8/1996 | Stowe | 208/106 |
| 5,727,628 | * | 3/1998 | Patzner | 166/249 |

FOREIGN PATENT DOCUMENTS 2257184A 7/1992 (GB) .

OTHER PUBLICATIONS

V.N. Nikolaevskiy et al., Residual Oil Reservoir Recovery with Seismic Vibrations, *SPE Production & Facilities*, May 1996, pp. 89–94.

S.D. Ball et al., Transient Interfacial Tension Behavior Between Acidic Oils and Alkaline Solutions, *Chem. Eng. Comm.*, vol. 147, pp. 145–156 (1996).

A.M. Sarem, Low Cost Recovery Improvement of HighWor Waterfloods by MCCF Historical Review, pp. 529–539. (undated).

J. Wang et al., Study of Enhanced Heavy Oil Recovery by Hot Caustic Flooding, *Heavy Crude and Tar Sands —Hydrocarbons for the 21st Century*, pp. 419–440. (undated).

(List continued on next page.)

*Primary Examiner*—William Neuder
*Assistant Examiner*—Jennifer Dougherty
(74) *Attorney, Agent, or Firm*—Gary L. Haag

(57) ABSTRACT

This invention provides an apparatus and process for producing heavy crude oil from a subterranean formation penetrated by a well bore. In accordance with the process, an aqueous alkaline chemical solution is introduced into or formed in the well bore penetrating the formation. The aqueous alkaline chemical solution mixes and reacts with produced heavy crude oil in the well bore and ultrasonic waves are emitted into the mixture whereby an emulsion is formed. The viscosity of the formed emulsion is less than that of the crude oil or the crude oil and water mixture flowing into the well bore which allows the oil to be more efficiently pumped to the surface and transported for further processing.

29 Claims, 2 Drawing Sheets

OTHER PUBLICATIONS

H.M. Cekirge et al., State–Of–The–Art Modeling Capabilities For Orimulsion Modeling, GFDI, Fl. State Univ., pp. 805–820. (undated).

Caustic Flooding Cost Efficient, *Oilweek*, Sep. 29, 1980, pp. 29–30.

Good Prospects Overcome Domestic Politics, *World Oil*, Aug., 1997, pp. 57–66.

Brochure entitled Etrema Terfenol–D® Magnetostrictive Actuators for Etrema Products, Inc. (undated).

L. Stavnicky, Design Dimensions—Magnetostrictive Actuators, *Designfax*, Jul., 1994.

M. Goodfriend, Material Breakthrough Spurs Actuator Design, *Machine Design*, vol. 63, No. 6, Mar. 21, 1991, pp. 147–150.

Material "Megamorphs" in Magnetic Field, *Machine Design*, Aug., 1994.

Y.S. Ashchepkov, Infiltration Characteristics of Inhomogeneous Porous Media in a Seismic Field, *Soviet Mining Science*, vol. 25, No. 5, 1990, pp. 492–496.

H.V. Fairbanks et al., Ultrasonic Acceleration of Liquid Flow Through(undated) Porous Media, *Sonochemical Engineering*, No. 109, Vol. 67, pp. 108–116.

N. Akbar et al., Relating P–wave Attenuation to Permeability, *Geophysics*, vol. 58, No. 1 , Jan., 1993, pp. 20–29.

K.K. Mohanty et al., Physics of Oil Entrapment in WaterWet Rock, *SPE Reservoir Engineering*, Feb., 1987, pp. 113–128.

R. Gibson, Jr., Radiation From Seismic Sources in Cased and Cemented Boreholes, *Geophysics*, vol. 59, No. 2, Apr., 1994, pp. 518–533.

I.A. Beresnev et al., Elastic–Wave Stimulation of Oil Production: A Review of Methods and Results, *Geophysics*, vol. 59, No. 6, Jun., 1994, pp. 1000–1017.

Text literature from Chapter 6, Section 6.7 entitled Basic Aspects of Cavitation in Liquids, *Physical Mechanisms for Sonic Processing*, pp. 225–244. (undated).

* cited by examiner

HEAVY OIL VISCOSITY REDUCTION AND PRODUCTION

BACKGROUND OF THE INVENTION

1. Field of the Invention

This invention relates to apparatus and methods for reducing the viscosity of crude oil produced from a subterranean formation in order to facilitate pumping and/or transporting the oil.

2. Description of the Prior Art

The production of crude oil from an oil reservoir is generally assisted to a great extent by naturally occurring forces associated with the reservoir. These naturally occurring forces include the expanding force of natural gas, the buoyant force of approaching water and the force of gravity. Primary recovery techniques utilize these forces to cause the oil to migrate from the formation into the well bore. Unfortunately, the natural forces are typically only sufficient to allow a small percentage of the total oil in the reservoir to be produced.

Secondary recovery techniques are generally employed to recover more of the oil in the formation. These techniques utilize extraneous energy forces to supplement the naturally occurring forces in the formation and force the oil from the formation into the well bore. The extraneous forces can be generated from a large variety of sources including gas injection, steam injection and water injection. Secondary recovery techniques are typically initiated even before the primary forces of the reservoir are exhausted.

Water flooding is one example of a secondary recovery technique that has been successfully employed in different types of formations. Generally, in accordance with water flooding techniques, one or more injection wells and one or more production wells are utilized. An aqueous solution is injected through the injection well(s) in order to drive the oil to the production well(s) where it can be produced. Many modifications to basic water flooding techniques have been developed. These modifications include the use of certain chemicals and materials in the injection water to help displace the oil from the formation. For example, thickening agents are often employed to thicken the water and thereby increase its efficiency in driving the oil to the producing well(s). Surfactants have been employed to reduce the surface tension of the oil in the formation and thereby facilitate its production.

Aqueous alkaline solutions, e.g., caustic solutions, have been successfully utilized for flooding certain types of reservoirs. For example, alkali metal hydroxides such as sodium hydroxide react with organic acids present in the oil and depress the interfacial tension between the oil and the water resulting in emulsification of the oil. The emulsified oil is more easily displaced from the formation. This type of secondary recovery technique is often referred to as caustic flooding.

Another secondary recovery technique that has been employed to increase the recovery of oil in certain situations involves the use of sonic energy. For example, sonic stimulation has been utilized in Russia to improve oil production in depleted water flooded and water-dry oil reservoirs. The sound waves generally function to heat and reduce the viscosity of the oil, increase the permeability of the formation and generally induce migration of the oil to the well bore.

Secondary recovery techniques involving heavy and highly viscous crude oil ("heavy crude oil") are especially challenging. In order to efficiently produce heavy crude oil, the viscosity of the oil must be substantially reduced. Transportation of heavy crude oil (e.g., by pipeline) can also be difficult to accomplish in an efficient manner unless the viscosity of the oil is first reduced. Numerous techniques have been employed to reduce the viscosity of heavy oil. For example, U.S. Pat. No. 3,823,776 to Holmes discloses a process for increasing the recovery of heavy oil having a low acid value whereby an oxygen-containing gas is injected into the formation to oxidize the oil and establish an in situ combustion zone in the formation. An aqueous caustic solution is then injected into the well to quench the in situ combustion zone and react with organic acids present in the oil to facilitate production of the oil. U.S. Pat. No. 2,670,801 to Sherborne discloses that ultrasonic energy (10 to 3,000 kHz) facilitates recovery of heavy oil by in situ heating of the oil droplets and emulsification of the droplets to a water phase saturated with gas.

Unfortunately, the techniques utilized heretofore to facilitate recovery of heavy oil from subterranean formations are often not very successful. The cost of reducing the viscosity of heavy oil to a level whereby the oil can be lifted out of the formation and transported for further processing often exceeds the potential gain to be realized by producing the oil. Accordingly, there is a need for an improved apparatus and corresponding process for treating heavy crude oil produced from a petroleum reservoir whereby the viscosity of the oil can be substantially reduced and the oil can be produced and transported for further processing in an economical and efficient manner.

SUMMARY OF THE INVENTION

It has been discovered that the viscosity of viscous and often heavy crude oil can be dramatically reduced by converting the oil to a stable microemulsion. The microemulsion is formed by combining alkaline chemicals with the oil and subjecting it to ultrasonic energy. The reduction in the viscosity of the oil allows it to be efficiently pumped out of the well bore and transported from the well site for further processing, i.e., the lifting costs and pipeline transportation costs are dramatically reduced.

In one aspect, the present invention provides apparatus for increasing the recovery of heavy crude oil from a subterranean oil bearing formation penetrated by at least one well bore. The apparatus includes storage means positioned on the surface for containing an alkaline chemical or aqueous alkaline chemical solution (e.g., one or more storage tanks on the drill site), conduit means extending from the storage means through the well bore to the formation for conducting the alkaline chemical or aqueous alkaline chemical solution from the storage means to the formation, and ultrasonic stimulation means positioned within the well bore for emitting ultrasonic waves into heavy oil-water-alkaline chemical mixture formed in the well bore. The ultrasonic stimulation means includes a transducer positioned in the well bore for emitting ultrasonic waves into the oil-water-alkaline chemical mixture in the formation whereby the oil and water are converted to a lower viscosity emulsion, and electric power means operably connected to the transducer for providing energy to the transducer. The transducer preferably includes an electric powered magnetostrictive actuator, more preferably an electric powered magnetostrictive actuator comprised of a drive rod formed of a terfenol alloy.

In another aspect, the present invention provides a process for producing heavy crude oil from a subterranean oil bearing formation penetrated by at least one well bore. In accordance with the process, an alkaline chemical or aqueous alkaline chemical solution is introduced into the well bore into which heavy oil and water or heavy oil alone is produced. The alkaline chemical or aqueous alkaline solution is introduced into the well bore in an amount sufficient to mix with the heavy crude oil and water or the heavy crude oil alone in the well bore. Simultaneously with the introduction of the alkaline chemical or aqueous solution thereof into the well bore, the resulting mixture of oil, water and alkaline chemical is subjected to ultrasonic stimulation by emitting ultrasonic waves therein which converts the mixture into a lower viscosity emulsion. The emulsion is then produced from the formation through the well bore and transported by pipeline to a point of further processing.

The procedure by which the viscosity reduction of the heavy crude oil is achieved includes the use of water or brine with an alkaline chemical additive such as sodium hydroxide, calcium hydroxide, sodium silicates and other strong bases. The water (or brine) used to make up the alkaline solution can either be supplied from an external source or in part or in total from water (or brine) produced with the oil. When the resulting water (or brine) and alkaline chemical are mixed with the heavy crude oil in the presence of ultrasonic stimulation, a semi-stable to stable emulsion is rapidly formed which has a dramatically lower viscosity than the untreated viscous oil.

It is, therefore, an object of the present invention to provide an apparatus and process whereby the effective viscosity of heavy crude oil produced into a well bore is substantially reduced thereby allowing the oil to be produced and transported from the well in an economical and efficient manner.

Additional objects, features and advantages of the invention will be readily apparent to those skilled in the art upon a reading of the detailed description of preferred embodiments of the invention which follows.

DETAILED DESCRIPTION OF PREFERRED EMBODIMENTS OF THE INVENTION

Figure 1:
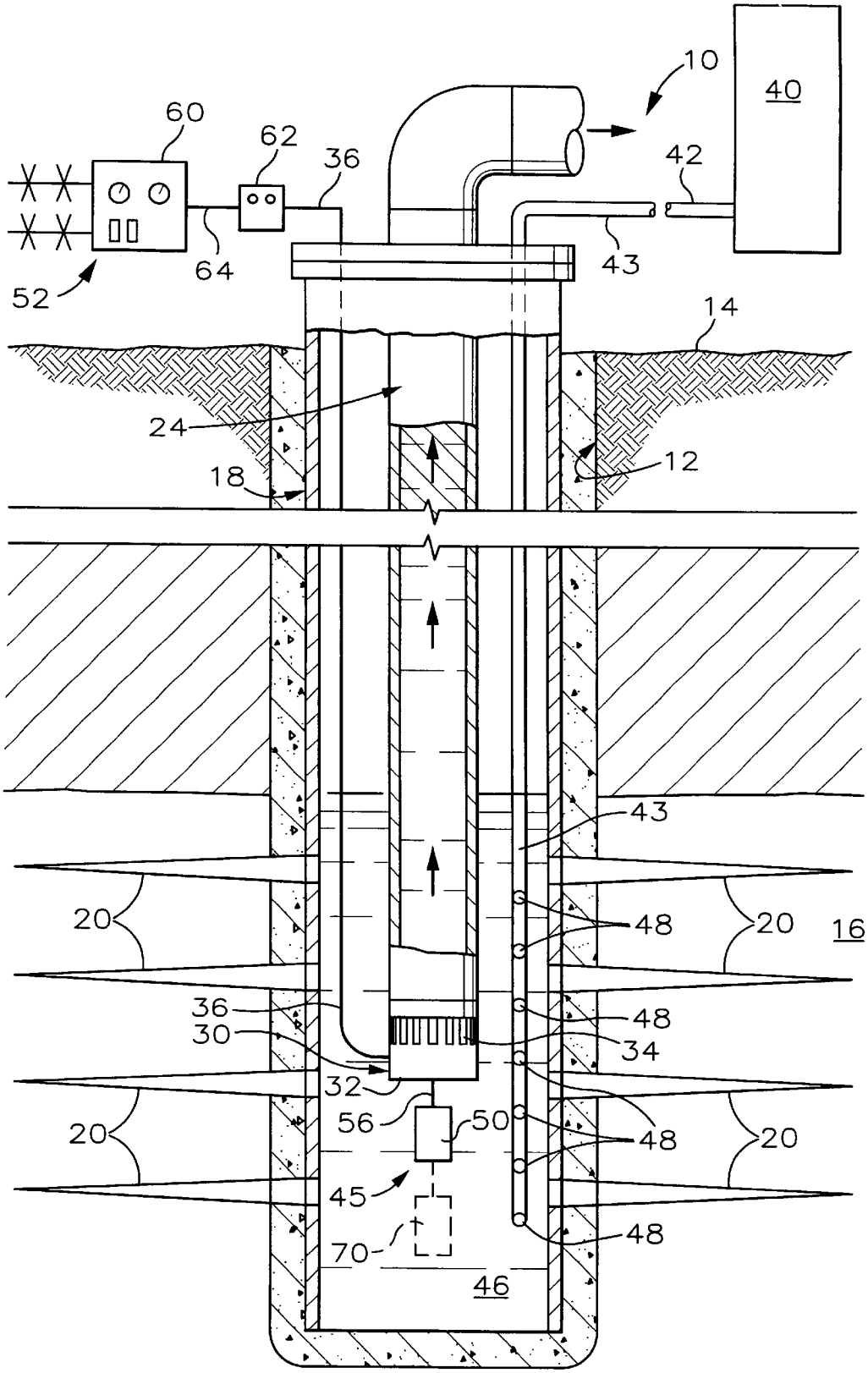
FIG. 1 is a schematic view illustrating the inventive apparatus and process when employed in a well bore.

By the present invention, an apparatus and process for producing heavy crude oil from a subterranean oil bearing formation penetrated by a well bore are provided. The apparatus and process can be used in the bottom of the well bore as described herein and/or at the entrance of a surface or subsea pipeline or other location where it is desirable to reduce the viscosity of oil. As used herein and in the appended claims, the term "heavy crude oil" means crude oil having an API gravity of less than about 20. Such heavy oils typically have viscosities in excess of 1,000 centipoises at ambient conditions of temperature and pressure.

The application of ultrasonic energy to heavy crude oil, water or brine and an alkaline chemical makes it possible to generate stable microemulsions having low viscosities. A key to implementation of this technique is to start with the viscosity of the oil in a range where it can participate in emulsion forming mechanisms with water or brine. For heavy crude oil that is extremely viscous, it may be necessary to heat the oil to reduce the viscosity such that it falls in a range where emulsions can be formed. The ultrasonic stimulation process contributes to the heating of the oil.

For oil that is extremely viscous, it is sometimes more effective to initially lower the viscosity of the oil before ultrasonic treatment of the mixture of oil, water or brine and alkaline chemical. Laboratory experiments indicate that there is a relationship between the initial viscosity of an oil prior to ultrasonic treatment and the viscosity of the emulsion formed. If the initial viscosity of the oil is extremely high, the viscosity of the resultant emulsion may still be higher than desired to obtain a fluid with good flow characteristics. However, by heating extremely viscous oil prior to ultrasonic treatment, a lower viscosity microemulsion can be obtained. This heating of the oil can be achieved in various ways such as by placing a heating apparatus in the well bore, injecting steam in the well bore and the like.

Referring now to the drawing, a preferred embodiment of the inventive heavy oil recovery apparatus, generally designated by the numeral 10, is described. As schematically illustrated, a well bore 12 extends from the surface 14 and penetrates a heavy oil producing subterranean formation 16. A cemented casing 18 extends around the perimeter of the well bore 12. A plurality of perforations 20 extend through the cemented casing 18 into the formation 16 and establish fluid communication between the well bore 12 and the formation 16. A string of production tubing 24 extends through the well bore 12 from the surface 14 to a point in the well bore within the formation 16 and adjacent to the perforations 20. The tubing 24 conducts oil from the formation 16 to the surface 14. A submersible electric pump 30 having a motor 32, inlet 34 and electric wireline 36 are attached to the production tubing 24. The pump 30 pumps oil through the tubing 24 to the surface 14. The exact structures of the casing 18, perforations 20, tubing 24, pump 30 and associated equipment (e.g., guide apparatus, centralizers and so forth) are not critical to the present invention and have been generally described only to the extent necessary to illustrate the invention. The nature and operation of such equipment are well known to those skilled in the art.

The apparatus 10 includes storage means generally designated by the numeral 40 positioned on the surface 14 for containing an alkaline chemical or the components of an aqueous alkaline chemical solution. Conduit means 42 extend from the container means 40 through the well bore 12 to the formation 16 for conducting the alkaline chemical or aqueous alkaline chemical solution from the storage means to near the bottom of the well bore 12 within the producing formation 16. Ultrasonic stimulation means 45 are positioned within the well bore 12 for imparting ultrasonic wave energy to a mixture 46 of heavy crude oil, water and alkaline chemical therein.

The storage means 40 includes one or more conventional mixing tanks (not shown). The conduit means 42 includes at least one capillary or other relatively small diameter tube 43 that extends through the well bore between the outside of the production tubing 24 and the inside of the casing 18. Tube 43 can include a plurality of injection nozzles 48 that inject an alkaline chemical or aqueous alkaline chemical solution into the well bore 12 whereby the alkaline chemical or solution contacts and mixes with heavy crude oil or heavy crude oil and water therein.

The alkaline chemical or aqueous alkaline chemical solution is pumped from the storage means 40 into the tube 43. The solution can be batch mixed in the storage means or, alternatively, the components can be individually conducted or conveyed from separate tanks and mixed on the fly as they are pumped into the tube 43.

The ultrasonic stimulation means 45 includes one or more transducers 50 positioned in the well bore for emitting ultrasonic wave energy into the well bore and into the mixture of heavy crude oil, water and alkaline chemical therein and an electric power means 52 operably connected to the transducer(s) 50. As used herein and in the appended claims, "positioned in the well bore" means positioned at a point in the well bore such that the ultrasonic waves emitted by the transducer(s) 50 contact the mixture of heavy crude oil, water and alkaline chemical in the general vicinity of where the oil enters the well bore. For example, the transducer(s) 50 can be positioned in the well bore 12 slightly above, slightly below or within the portion of the well bore actually penetrating the heavy oil producing formation 16. Preferably, the transducer(s) 50 are submerged in the fluid mixture 46 in the bottom of the well bore 12.

The transducer(s) 50 can be mounted directly on the pump 30 or other portion of the work string. Alternatively, as shown in the drawing, the transducer(s) 50 can be suspended by a cable 56 below the pump 30. In some cases, it is advantageous to employ a plurality of transducers 50 in regularly spaced positions along the perforated portion of the casing 18. In addition to assuring that the heavy crude oil and other components mixed therewith in the well bore 12 are contacted by ultrasonic waves, the use of multiple transducers strategically placed in the oil flow path ensures that the viscosity of the oil is reduced and maintained at a sufficiently low level prior to when the oil is pumped by the pump 30. The intensity of the energy imparted by each transducer 50 as well as the exact number of transducers that should be used will vary depending on several factors including the ultrasonic wave exposure time required to reduce the viscosity of the oil to a sufficient level and the overall production rate of the well.

Figure 2:
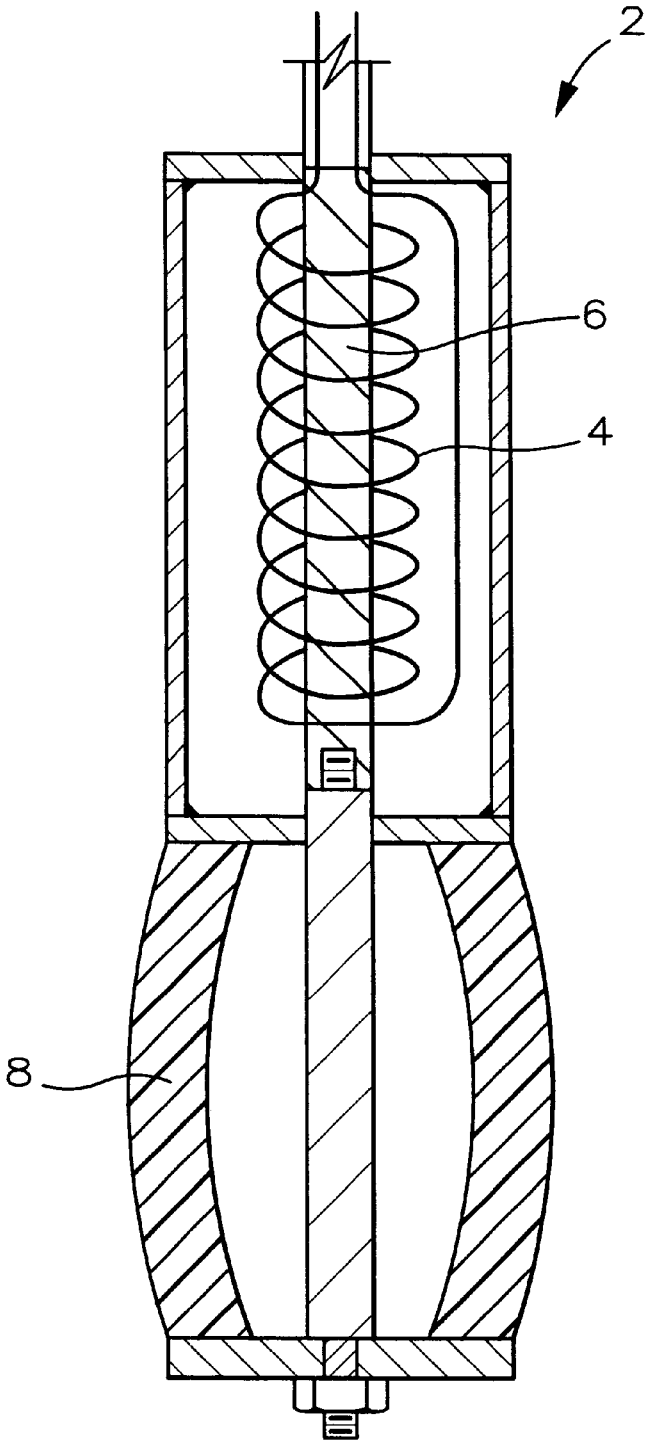
FIG. 2 is a cross-sectional, partially schematic illustration of an energy transducer useful in accordance with this invention.

Each transducer 50 that is employed preferably includes an electric powered magnetostrictive actuator, most preferably a magnetostrictive actuator comprised of a drive rod formed of a terfenol alloy. The terfenol alloy is composed of the metals terbium, dysprosium and iron. Each transducer 50 directly transforms electrical energy into mechanical action. In one embodiment, a terfenol rod is attached to a radiating bar or other element. Referring to the energy transducer generally designated by the numeral 2 in FIG. 2, a coil 4 surrounding the terfenol rod 6 creates an alternating magnetic field in the rod 6 which causes the rod 6 to extend and contract resulting in a corresponding displacement of the attached bar or other element 8. The excitation of the attached bar or other element 8 imparts the ultrasonic waves to the mixture of heavy crude oil, water and alkaline chemical in the well bore 12. Particularly preferred transducer actuators for use in accordance with this invention include Terfenol-D® drive rods and are commercially available from Extrema Products, Inc. of Ames, Iowa.

The power means 52 of the ultrasonic stimulation means 45 includes an electric control unit 60 positioned on the surface 14, a signal conditioning unit 62 located at the surface 14 or located in the well bore 12 between the control unit and the transducer(s) 50, and the electric wireline 36 extending and transmitting electric power from the control unit 60 to the signal conditioning unit 62 and then to the transducer(s) 50.

The use of transducers having magnetostrictive actuators including terfenol alloy drive rods to impart sonic energy to the heavy crude oil is very advantageous. The terfenol alloy drive rod is a great improvement compared to prior art actuators including sucker rods or pizeo crystals for a variety of reasons. First, actuators including terfenol drive rods are more durable than other types of actuators and they do not fatigue as easily. Actuators with terfenol rods are also more energy efficient than, for example, pizeo crystal actuators. A greater amount of electricity is converted into sonic waves by actuators with terfenol drive rods. Also, actuators with terfenol drive rods are highly tunable allowing resonant frequency levels to be established.

In carrying out the inventive process, it may first be necessary to reduce the viscosity of the heavy crude oil in the well bore by heating the oil. That is, when the heavy crude oil produced into the well bore has a very high initial viscosity, i.e., a viscosity above about 10,000 centipoises, the viscosity of the emulsion produced may not be at a low enough level. While the ultrasonic wave energy imparted to the oil heats it to some extent, it may be necessary to install a heater 70 such as an electric powered heater in the well bore (shown in dashed lines in the drawing) to heat the oil and lower its viscosity to a level below about 10,000 centipoises, preferably to a range of from about 1,000 to about 8,000 centipoises and most preferably to from about 2,500 to about 4,000 centipoises. Other techniques of heating the oil can also be utilized such as injecting steam into the formation and the like.

As mentioned above, the water or brine required to form a microemulsion with the heavy crude oil in the well bore 12 can be water produced with the oil whereby only the alkaline chemical must be pumped from the storage means 40 on the surface 14. If little or no water is produced with the heavy crude oil, the required water can be mixed with the alkaline chemical on the surface 14 and pumped into the well bore 12 as an alkaline chemical solution.

The alkaline chemical or aqueous alkaline chemical solution used is pumped from the storage means 40 into the tube 43 and through the nozzles 48 into the well bore 12 adjacent to the formation 16. Upon entering the well bore 12, the alkaline chemical or aqueous alkaline chemical solution contacts and mixes with the heavy crude oil and water or the heavy crude oil alone therein. The alkaline chemical reacts with naphthenic and other acids present in the crude oil to form large "soap-like" molecules having a low interfacial tension. As the alkaline chemical contacts and reacts with the heavy crude oil, the crude oil is bombarded with ultrasonic waves emitted from the ultrasonic transducer(s) 50. The combined use of an alkaline chemical and ultrasonic energy in the presence of water and oil results in the rapid formation of a semi-stable to stable emulsion, generally a microemulsion. As stated above, in this emulsified state, the crude oil has a significantly lower viscosity than the viscosity of the crude oil alone or the crude oil mixed with water.

The aqueous alkaline solution that is pumped into the well bore 12 or formed therein has a pH of at least about 8 and the chemical or solution is introduced into the formation at a rate sufficient to form a microemulsion with the rate of heavy crude oil flowing into the well bore. Preferably, the aqueous alkaline solution has a pH in the range of from about 10 to about 13, more preferably in the range of from about 12 to about 13. The solution contains the alkaline chemical in a concentration in the range of from about 0.001 to about 10 molar, more preferably in the range of from about 0.01 to about 8 molar.

The alkaline chemical used is preferably selected from the group consisting of sodium hydroxide, calcium hydroxide, sodium silicate compounds, sodium bicarbonate, magnesium hydroxide and mixtures thereof. More preferably, the alkaline chemical is selected from the group consisting of sodium hydroxide and calcium hydroxide. Most preferably, the alkali metal hydroxide is sodium hydroxide. The specific rate of aqueous alkaline solution introduced into or formed in the well bore 12 will vary depending upon various factors including the production rate of the heavy crude oil into the well bore 12, the initial viscosity of the heavy crude oil and the production rate of water, if any. Generally, the aqueous alkaline chemical solution is introduced into or formed in the well bore whereby the volume ratio of the aqueous alkaline chemical solution to heavy crude oil is in the range of from about 1:10 to about 10:1, more preferably from about 1:3 to about 3:1; most preferably about 1:2.

The ultrasonic waves produced by the transducer(s) 50 are emitted in the well bore 12 at a frequency sufficient to enhance the formation of a stable emulsion between the water therein and the reaction product of the alkaline chemical with the heavy crude oil therein. The exact frequency and energy intensity of the emitted ultrasonic waves is dependent on various characteristics of the oil such as its initial viscosity, production rate and the like. Generally, the ultrasonic waves emitted into the well bore by the ultrasonic transducer(s) 50 are at a frequency of at least about 15 kilohertz, more preferably at a frequency in the range of from about 15 kilohertz to about 25 kilohertz and most preferably at a frequency of 20 kilohertz. At a frequency of approximately 20 kilohertz, the corresponding energy intensity level is particularly effective in achieving the objects of the present invention. An ultrasonic transducer having a magnetostrictive actuator including a terfenol drive rod can be used to achieve energy intensities at the transducer of from about 0.1 to about 100 watts per square centimeter.

The time period for which the crude oil should be subjected to the ultrasonic energy to achieve the desired emulsification and viscosity reduction will vary from a few seconds to several minutes. In a preferred embodiment, the crude oil is continuously subjected to sonic stimulation while production is ongoing.

The following examples are provided to further illustrate the invention.

EXAMPLE 1

Tests were conducted on heavy crude oil from the Hamaca reservoir in Venezuela having an API gravity of approximately 8. Test samples of the oil were mixed with aqueous sodium hydroxide solutions at the temperatures and in the amounts given in Table I below. A number of the mixtures were insonicated (bombarded) with ultrasonic waves for the times given and producing the results shown in Table I below.

TABLE I

| Insonication[1] Time, min. | Temperature, ° C. | Aqueous Sodium Hydroxide Solution Amount[2], % by volume | Sodium Hydroxide Solution Concentration, molar | Viscosity[3], cp |
|---|---|---|---|---|
| No insonication | 23 | No additive | No additive | 785,600 |
| No insonication | 50 | No additive | No additive | 29,200 |
| 1 | 23 | 33 | 0.1 | Did not emulsify[4] |
| 5 | 23 | 33 | 0.1 | Very little emulsification[4] |
| 1 | 50 | 33 | 0.1 | Some emulsification[4] |
| 5 | 50 | 33 | 0.1 | Some emulsification[4] |

[1]All insonication was conducted at approximately 20 kHz.
[2]The percent by volume of the NaOH solution was based on the volume of the NaOH solution divided by the total volume of the crude oil and NaOH solution.
[3]The viscosities of the samples were measured using a Brookfield viscosimeter.
[4]The sample was not mixed well enough to give an accurate viscosity reading.

In a second series of tests, the temperatures employed were raised to some extent. The results of these tests are as follows:

TABLE II

| Insonication[1] Time, min. | Temperature, ° C. | Aqueous Sodium Hydroxide Solution Amount[2], % by volume | Sodium Hydroxide Solution Concentration, molar | Viscosity[3], cp |
|---|---|---|---|---|
| No insonication | 60 | No additive | No additive | 9880 |
| No insonication | 70 | No additive | No additive | 4448 |
| No insonication | 75 | No additive | No additive | 2832 |
| 1 | 75 | 33 | 0.1 | 9.90[4] |
| 3 | 75 | 33 | 0.1 | 6.60[4] |

TABLE II-continued

| Insonication[1] Time, min. | Temperature, ° C. | Aqueous Sodium Hydroxide Solution Amount[2], % by volume | Sodium Hydroxide Solution Concentration, molar | Viscosity[3], cp |
|---|---|---|---|---|

[1]All insonication was conducted at approximately 20 kHz.
[2]The percent by volume of the NaOH solution was based on the volume of the NaOH solution divided by the total volume of the crude oil and NaOH solution.
[3]The viscosities of the samples were measured using a Brookfield viscosimeter.
[4]These samples formed stable microemulsions and had very low viscosities even after cooling to room temperature.

From the results given in Table II, it can be seen that the process of the present invention achieves very significant heavy crude oil viscosity reduction.

Thus, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. Apparatus for increasing the recovery of heavy crude oil from a subterranean oil bearing formation penetrated by a well bore, comprising:

storage means positioned near the top of said well bore for containing an alkaline chemical or an aqueous alkaline chemical solution;

conduit means extending from said storage means through said well bore to near the bottom thereof for conducting said alkaline chemical or aqueous alkaline chemical solution from said storage means into said well bore; and ultrasonic stimulation means positioned within said well bore for emitting ultrasonic waves into a mixture of heavy crude oil, water and alkaline chemical contained therein.

2. The apparatus of claim 1 wherein said ultrasonic stimulation means comprises:

an electric powered ultrasonic wave transducer positioned in said well bore; and electric power means operably connected to said transducer.

3. The apparatus of claim 2 wherein said ultrasonic wave transducer includes a magnetostrictive actuator.

4. The apparatus of claim 3 wherein said actuator comprises a drive rod formed of terfenol alloy.

5. The apparatus of claim 2 wherein said electric power means comprises:

an electric power control unit positioned near the top of said well bore; and an electric control cable extending and transmitting electric power from said electric power unit to said transducer.

6. Apparatus for producing heavy crude oil from a subterranean oil bearing formation penetrated by a well bore, comprising:

a production tubing string disposed within said well bore for conducting oil from the bottom of said well bore to the top of said well bore;

a pump attached to the bottom of said production tubing string for pumping oil through said production tubing string;

storage means positioned near the top of said well bore for containing an alkaline chemical or an aqueous alkaline chemical solution;

conduit means extending from said storage means through said well bore to near the bottom of said well bore for conducting said alkaline chemical or aqueous alkaline chemical solution from said storage means into said well bore; and ultrasonic stimulation means positioned within said well bore for emitting ultrasonic waves into a mixture of heavy crude oil, water and alkaline chemical therein.

7. The apparatus of claim 6 wherein said ultrasonic stimulation means comprises:

an electric powered ultrasonic wave transducer positioned in said well bore; and electric power means operably connected to said electric powered ultrasonic wave transducer.

8. The apparatus of claim 7 wherein said ultrasonic wave transducer includes a magnetostrictive actuator.

9. The apparatus of claim 8 wherein said actuator comprises a drive rod formed of terfenol alloy.

10. The apparatus of claim 7 wherein said electric power means comprises:

an electric power control unit positioned near the top of said well bore;

an electric signal conditioning unit connected between said electric power control unit and said electric powered ultrasonic wave transducer; and an electric wire line extending and transmitting electric power from said electric power control unit to said electric signal conditioning unit and to said electric powered ultrasonic wave transducer.

11. A process of reducing the viscosity of heavy crude oil comprising the steps of:

mixing and reacting an aqueous alkaline chemical solution having a pH of at least about 8 with said heavy crude oil in an amount sufficient to form an emulsion therewith; and subjecting the resulting reaction mixture of heavy crude oil and aqueous alkaline chemical solution to stimulation by emitting ultrasonic waves thereinto whereby an oil-water emulsion of reduced viscosity is formed.

12. The process of claim 11 wherein said aqueous alkaline chemical solution has a pH in the range of from about 10 to about 13.

13. The process of claim 11 wherein said aqueous alkaline chemical solution contains an aqueous alkaline chemical in a concentration in the range of from about 0.001 to about 10 molar.

14. The process of claim 11 wherein said aqueous alkaline chemical solution contains an alkaline chemical that is selected from the group consisting of sodium hydroxide, calcium hydroxide, sodium silicate compounds, sodium bicarbonate, magnesium hydroxide and mixtures thereof.

15. The process of claim 11 wherein the volume ratio of said aqueous alkaline chemical solution to said heavy crude oil in said mixture is in the range of from about 1:10 to about 10:1.

16. The process of claim 11 which further comprises heating said heavy crude oil to reduce the initial viscosity thereof prior to mixing said aqueous alkaline chemical solution therewith.

17. The process of claim 11 which further comprises the step of:

heating said produced heavy crude oil and water or produced heavy crude oil alone in said well bore to reduce the initial viscosity of said heavy crude oil.

18. The process of claim 17 wherein the initial viscosity of said heavy crude oil in said well bore is reduced to a level in the range of from about 1,000 to about 8,000 centipoise.

19. The process of claim 17 wherein the initial viscosity of said heavy crude oil in said well bore is reduced to a level in the range of from about 2,500 to about 4,000 centipoises.

20. A process for producing heavy crude oil from a subterranean oil bearing formation penetrated by a well bore, comprising the steps of:

introducing an alkaline chemical or aqueous alkaline chemical solution into said well bore, said well bore containing produced heavy crude oil and water or produced heavy crude oil alone whereby an aqueous alkaline chemical solution is formed or introduced therein having a pH of at least about 8 and being present in an amount sufficient to mix and react with said heavy crude oil and form an emulsion in said well bore;

subjecting said mixture of heavy crude oil and alkaline chemical solution to emulsion forming stimulation by emitting ultrasonic waves into said well bore; and producing said emulsion from said well bore.

21. The process of claim 20 wherein said aqueous alkaline chemical solution has a pH in the range of from about 10 to about 13.

22. The process of claim 20 wherein said alkaline chemical is present in said aqueous alkaline chemical solution in a concentration in the range of from about 0.001 to about 10 molar.

23. The process of claim 22 wherein said alkaline chemical is selected from the group consisting of sodium hydroxide, calcium hydroxide, sodium silicate compounds, sodium bicarbonate, magnesium hydroxide and mixtures thereof.

24. The process of claim 23 wherein said alkaline chemical is sodium hydroxide.

25. The process of claim 20 wherein said aqueous alkaline chemical solution is introduced into said well bore in an amount whereby the volume ratio of aqueous alkaline chemical solution to heavy crude oil in said well bore is in the range of from about 1:10 to 10:1.

26. The process of claim 20 wherein said ultrasonic waves are emitted into said well bore at a frequency in the range of from about 15 kilohertz to about 25 kilohertz.

27. The process of claim 20 wherein said ultrasonic waves are emitted into said well bore by at least one electric powered ultrasonic wave transducer disposed in said well bore.

28. The process of claim 27 wherein said transducer includes a magnetostrictive actuator.

29. The process of claim 28 wherein said magnetostrictive actuator comprises a drive rod formed of terfenol alloy.

* * * * *